United States Patent [19]

Jeffrey

[11] Patent Number: 4,790,498

[45] Date of Patent: Dec. 13, 1988

[54] SPACE SPINNER

[76] Inventor: Daniel Jeffrey, 108 N. 5th St., Martins Ferry, Ohio 43935

[21] Appl. No.: 167,023

[22] Filed: Mar. 11, 1988

[51] Int. Cl.[4] ..... B64C 31/06

[52] U.S. Cl. ..... 244/153 A

[58] Field of Search ..... 244/153 A, 153 R, 155 R, 244/155 A

[56] References Cited

U.S. PATENT DOCUMENTS

| | | | |
|---|---|---|---|
| 3,079,115 | 2/1963 | Edwards et al. | 244/153 A |
| 3,108,770 | 10/1963 | Mullinix | 244/153 A |
| 3,997,136 | 12/1976 | Finn | 244/153 A |
| 4,121,794 | 10/1978 | Lemelson | 244/153 A |
| 4,606,518 | 8/1986 | Jeffrey | 244/153 A |

*Primary Examiner*—Sherman D. Basinger
*Assistant Examiner*—Stephen P. Avila
*Attorney, Agent, or Firm*—William J. Ruano

[57] ABSTRACT

A space spinning kite comprising a stabilizing disc and a wing of rigid light weight material assembled at right angles to each other. The wing has a central slot through which a pair of closely spaced radially extending elements are rotated from the slot to a position at right angles to the disc, engaging both sides of the disc. A pair of slots on both sides of the center of the wing engage opposite surfaces of the disc in the vicinity of angular extremities to the slot.

2 Claims, 1 Drawing Sheet

SPACE SPINNER

This invention relates to a rotating type of kite which derives its lift from the wind-blown rotation of a wing, and stabilizer on a center dowel. It comprises an improvement over my U.S. Pat. No. 4,606,518 dated Aug. 19, 1986.

BACKGROUND OF THE INVENTION

A disadvantage of the structure shown in the above-mentioned patent is that even by unduly enlarging the thickness of parts and the weight thereof, the stabilizing disc cannot generally be frictionally maintained in a position at right angles to the wing, therefore causing faulty operation.

SUMMARY OF THE INVENTION

It is therefore an object of the invention to overcome the above-mentioned disadvantages in my former space spinning design by providing simple and inexpensive means for assuring a right angular relationship between stabilizing disc and wing which takes the form of a rotatable pair of spaced elements rigidly mounted on a dowel which elements can be rotated through an angle of 90 degrees to assure locking of the stabilizing disc and wing in exact right angular relationship, thereby enabling the use of light weight parts.

DETAILED DESCRIPTION OF THE PREFERRED EMBODIMENT

Figure 1:
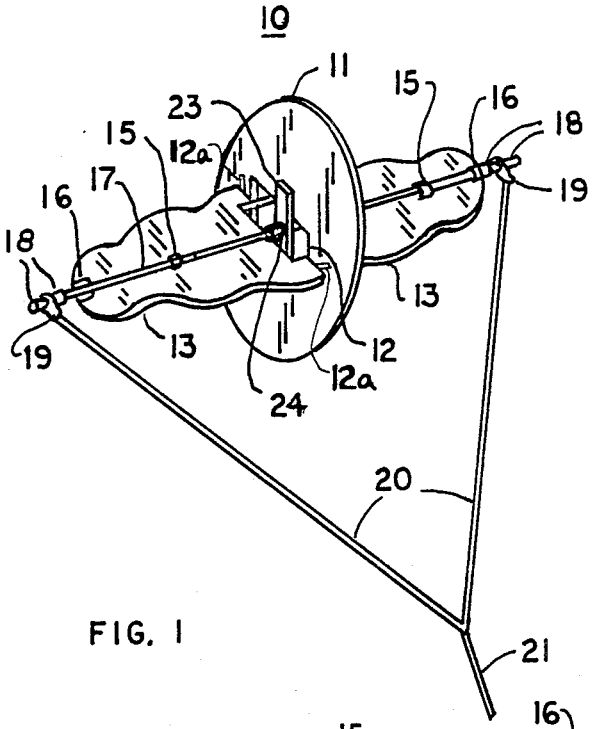
FIG. 1 is an isometric view of the kite which derives at least part of its lift by spinning about a solid dowel axis between the ends of a loop of string.
Figure 2:
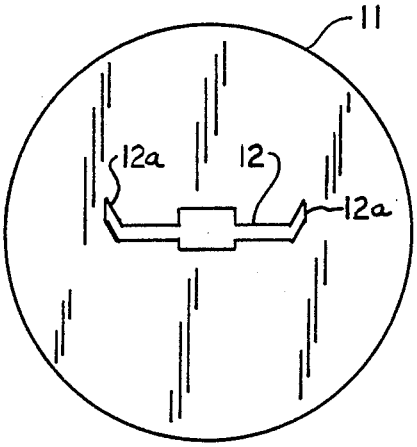
FIG. 2 is a plan view of the stabilizer disc before wing is inserted.
Figure 3:
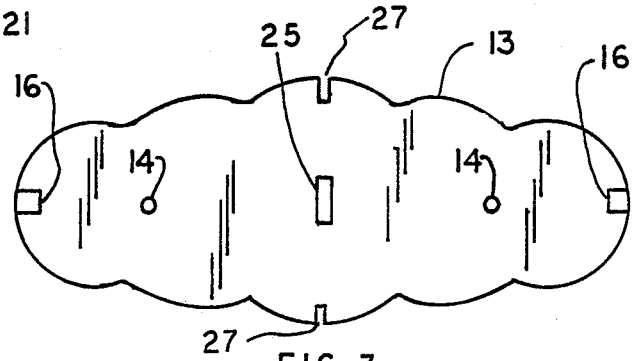
FIG. 3 is a plan view of the wing with masking tape secured externally to each end.
Figure 4:
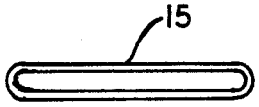
FIG. 4 is a plan view of a rubber band prior to securing it to the solid dowel and wing thereby holding both in place.
Figure 5:
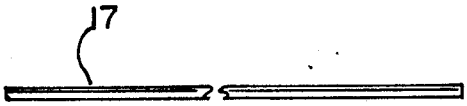
FIG. 5 is a plan view of the solid dowel which rotates as part of the kite assembly and also holds the secured spacers and bearings in place.
Figure 6:
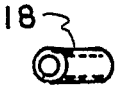
FIG. 6 is a plan view of a spacer before being permanently secured to the dowel on both ends.
Figure 7:
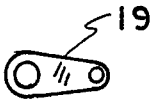
FIG. 7 is a plan view of a bearing before being affixed to the dowel on both ends between the secured spacers. The V-bridle of string is tied to the bearings.
Figure 8:
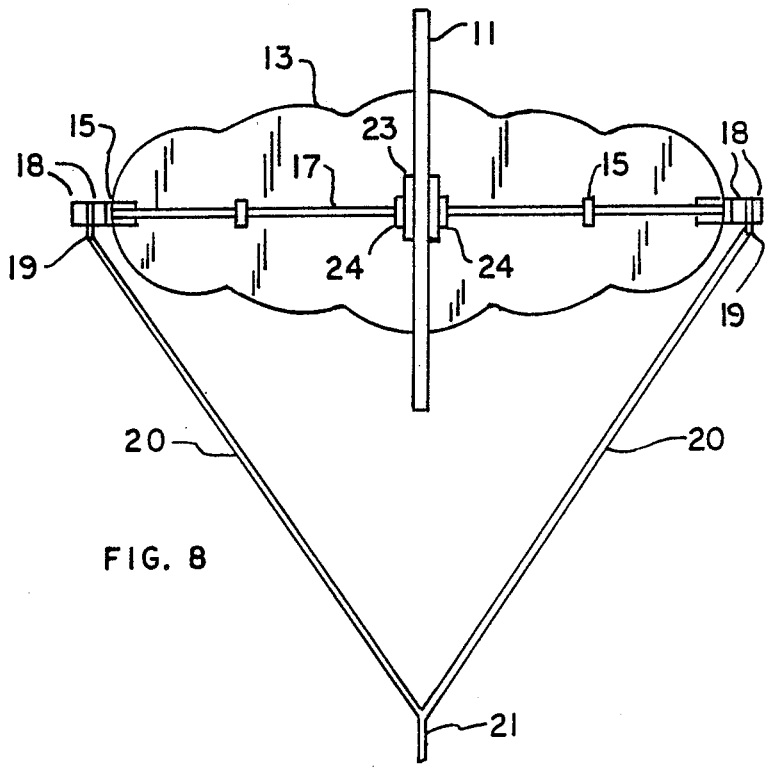
FIG. 8 is an elevational view of the kite assembly.

In FIG. 1 there is shown a space spinner, or kite, assembly 10 formed of a rigid lightweight material. Stabilizing disc 11 and a wing 13 are preferably constructed of a rigid lightweight material and are at right angles to each other, wherein the disc 11 is chordwise secured to the center of the wing as shown. The wing 13 and disc 11 are preferably of expanded polystrene to provide sufficient lightness to permit lift generated when the assembly 10 spins to overcome the weight of the assembly.

Wing 13 is shown frictionally retained in a slotted opening 12 having angular extremities 12*a* in the disc 11. The periphery of the center of wing 13 locks by slots 27 to disc 11 at imaginary extensions of slot 12 adjacent the angular extremities 12*a*, keeping wing 13 frictionally retained in opening 12. A pair of radially extending light weight elements 23 are rigidly secured to dowel 17, spaced apart by the thickness of disc 11 to give it support when rotated 90° from slot 25 to the position shown in FIG. 1. A small piece of masking tape 16 is secured externally to each end of wing 13.

It may be desirable to provide a pair of stop elements 24 in the form of small cylinders of rubber rigidly surrounding dowel 17 abutting both outer surfaces of elements 23.

The wing 13 is also preferably tapered towards its peripheral edges and a solid dowel 17 extending lengthwise externally to its median plane is affixed thereto by rubber bands 15 which extend through rubber band holes 14 in wing 13 and are stretched over the ends of the solid dowel 17 thereby holding the solid dowel 17 in place. As shown more clearly in FIGS. 1, 6, 7 and 8, two short rubber cylindrical spacers 18 are permanently secured on each end of solid dowel 17 and a bearing 19, in the form of a thin plate having a hole surrounding dowel 17, is affixed between each set of spacers 18. By making spacers of rubber or other yieldable material, no injury would result if the end of the solid dowel strikes one's face after launching the kite. An almost knife edge bearing is thus provided to reduce friction.

Tied to the other hole of bearing 19 is a V-bridle 20 of string attached to mooring line 21 of string which extends to the ground and may vary from 20 to 200 feet or more in length.

As wind strikes the wing 13, it causes the kite assembly 10 to easily rotate on the solid dowel 17 because of the almost frictionless bearings 19, and in so doing, to generate lift sufficiently to cause the space spinner to rise a substantial distance above the ground.

Thus it will be seen that I have provided a space spinner which is easily assembled with rubber bands and which has bearings of such low friction as to enable the spinner to rise rapidly into space by its ease of spinning, also, which has rubber spacers at the ends which will not cause injury if the kite ends strike the face of the launcher accidentally. Moreover, I have provided a space spinner having an easily replaceable dowel, as to material and size, since it is detachably mounted on the space spinner solely by rubber bands.

While I have illustrated and described a single specific embodiment of my invention, it will be understood that this is by way of illustration only and that various changes and modifications may be contemplated in my invention within the scope of the following claims.

I claim:

1. A space spinning kite, comprising a stabilizing disc and a wing formed of a rigid lightweight material, assembled at right angles to each other, wherein the disc is chordwise secured to the center of the wing, said wing being fictionally retained in a slotted opening in the disc and tapered towards its peripheral edges, a solid dowel extending lengthwise externally to the median plane of the wing and detachably secured thereto by rubber bands which extend through rubber band holes in the wing on opposite sides of said disc and which are stretched over the ends of the solid dowel, thereby detachably and yieldably holding the solid dowel in place, a pair of radially extending elements rigidly secured centrally of said dowel and being spaced apart by substantially the thickness of said stabilizing disc so as to normally engage the outer surfaces of said stabilzing disc to assure a right angular relationship between said stabilizing disc and wing, a slot centrally of said wing through which said elements extend, said slot being of slightly greater length than said radially extending elements whereby said elements may be turned by said dowel from a position within said slot to one at right angles thereto, a V bridle of string having extremities rotatably secured to the ends of said dowel, and a mooring line of string attached to the apex of said V-bridle and extending to the ground.

2. A kite as recited in claim 1 together with a Pair of cylindrical stop elements rigidly secured to said dowel adjacent outer ends of said radially extending elements.

* * * * *